US005460276A

United States Patent [19]

McKeon et al.

[11] Patent Number: 5,460,276

[45] Date of Patent: Oct. 24, 1995

[54] DINNERWARE CADDIE

[76] Inventors: Lisa A. McKeon, 20 Annandale Rd., Holbrook, N.Y. 11741; Sebastian Venza, 159 Rudolf Rd., Mineola, N.Y. 11501

[21] Appl. No.: 230,721

[22] Filed: Apr. 21, 1994

[51] Int. Cl.[6] ..... A47F 7/00

[52] U.S. Cl. ..... 211/70.7; 211/41; 211/181

[58] Field of Search ..... 211/70.7, 41, 88, 211/86, 106, 181; 248/231.7

[56] References Cited

U.S. PATENT DOCUMENTS

| | | | |
|---|---|---|---|
| 2,941,673 | 6/1960 | Lomas | 211/88 |
| 3,447,489 | 6/1969 | Kagan | 108/30 |
| 3,595,179 | 7/1971 | Taylor | 108/30 |
| 3,684,102 | 8/1972 | Colter | 211/88 |
| 4,648,511 | 3/1987 | Ritman | 206/541 |
| 4,756,582 | 7/1988 | Heien | 312/229 |
| 4,936,470 | 6/1990 | Prindle | 211/70.7 |
| 5,109,990 | 5/1992 | Murphy et al. | 211/41 |
| 5,197,626 | 3/1993 | Bernstein | 220/507 |

*Primary Examiner*—Blair M. Johnson
*Assistant Examiner*—Anita M. King
*Attorney, Agent, or Firm*—Richard L. Miller

[57] ABSTRACT

A dinnerware caddie is provided, which consists of a structure for holding a plurality of knives, forks, spoons, napkins and plates, and has a cooperating clamp assembly which is for mounting the holding structure in an upright position in a first situation to a table having only a top surface, and in an upright position in a second situation to a table's apron secured under the table's top.

3 Claims, 1 Drawing Sheet

DINNERWARE CADDIE

BACKGROUND OF THE INVENTION

The instant invention relates generally to containers and more specifically it relates to a dinnerware caddie.

Numerous containers have been provided in prior art that are adapted to hold various articles, such as items for serving food like dinnerware, flatware, jars and bottles. For example, U.S. Pat. Nos. 3,447,489 to Kagan; 3,595,179 to Taylor; 4,648,511 to Ritman and 5,197,626 to Bernstein all are illustrative of such prior art.

While these units may be suitable for the particular purpose to which they address, they would not be as suitable for the purposes of the present invention as heretofore described.

SUMMARY OF THE INVENTION

A primary object of the present invention is to provide a dinnerware caddie that will overcome the shortcomings of the prior art devices.

Another object is to provide a dinnerware caddie that will hold knives, forks, spoons, napkins and up to ten inch paper plates.

An additional object is to provide a dinnerware caddie that can be clamped to almost any type of table by a two position clamp and can also sit upon the table by itself.

A further object is to provide a dinnerware caddie that is simple and easy to use.

A still further object is to provide a dinnerware caddie that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

DETAILED DESCRIPTION OF THE PREFERRED EMBODIMENTS

Figure 1:
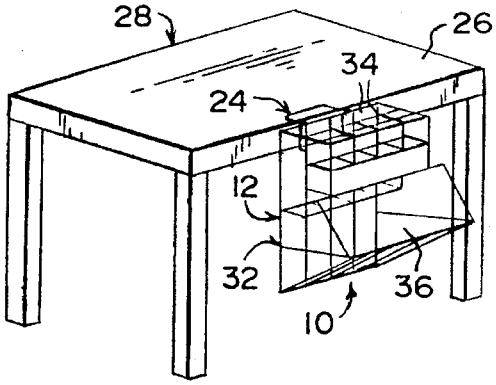
FIG. 1 is a diagrammatic perspective view of a table with the instant invention installed thereon.

Turning now descriptively to the drawings, in which similar reference characters denote similar elements throughout the several views, FIGS. 1 through 6 illustrate a dinnerware caddie 10, which consists of a structure 12 for holding a plurality of knives 14, forks 16, spoons 18, napkins 20 and plates 22. An assembly 24 is for mounting, in a first situation, the holding structure 12 in a first upright position A to an edge of a top 26 on a table 28 and, in a second situation, in a second upright position B to an apron 30 of a table 28*a*.

The holding structure 12 is a rack frame 32, having a plurality of top loading compartments 34 for storing the knives 14, forks 16, spoons 18, napkins 20 therein and a front loading compartment 36 for storing the plates 22 therein.

The mounting assembly 24 includes the rack frame 32 having a pair of spaced apart projections 38, 40 one above the other at the rear top edge 42 thereof. A two position C-shaped clamp 44 is provided, having a base 46, a first leg 48 and a second leg 50. A first transverse groove 52 is on an intersection of the base 46 and the first leg 48. A second transverse groove 54 is on an intersection of the base 46 and the second leg 50. A third transverse groove 56 is at a free edge of the second leg 50. A retainer screw 58 is threaded through the first leg 48 and extends towards the second leg 50. The clamp 44 can be oriented into the first position A with the first groove 52 engaging with the lower projection 38, the second groove 54 engaging with the upper projection 40 and the retainer screw 58 pressing the second leg 50 against the table top 26. The clamp 44 alternatively can be oriented into the second position B with the second groove 54 engaging with the lower projection 38, the third groove 56 engaging with the upper projection 40 and the retainer screw 58 pressing the second leg 50 against the apron 30.

The rack frame 32, the clamp 44 and the retainer screw 58 are fabricated out of a strong durable material 60, such as a metal typically stainless steel, plastic and similar substances.

OPERATION OF THE INVENTION

Figure 6:
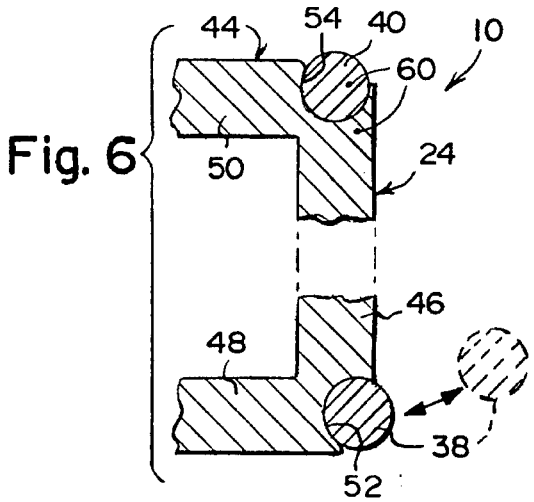
FIG. 6 is an enlarged diagrammatic cross sectional view, with parts broken away as indicated by arrow 6 in FIG. 4, illustrating how the two position clamp cooperates with the rack frame.
Figure 2:
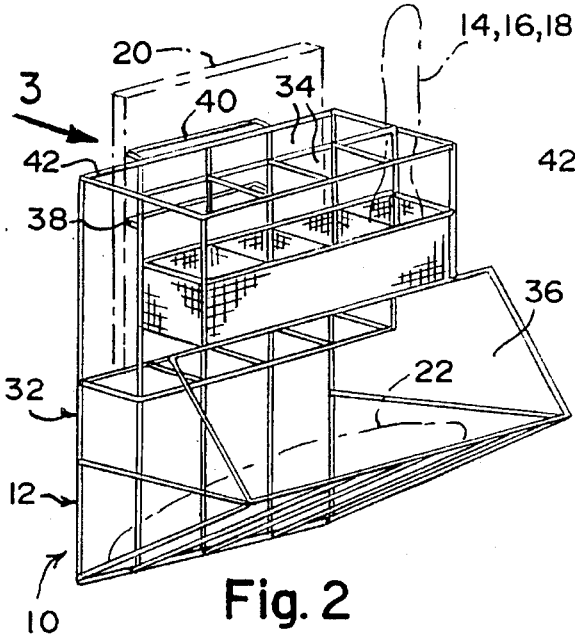
FIG. 2 is a front enlarged diagrammatic perspective view of the rack frame of the instant invention per se.
Figure 3:
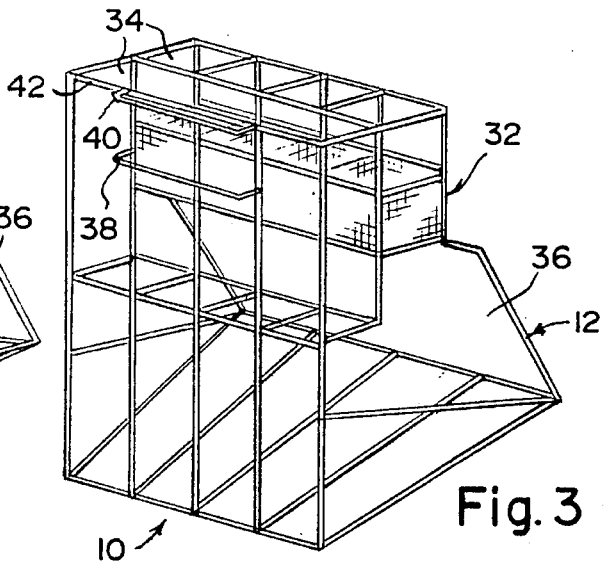
FIG. 3 is a rear enlarged diagrammatic perspective view of the rack frame of the instant invention per se taken generally in the direction of arrow 3 in FIG. 2.
Figure 4:
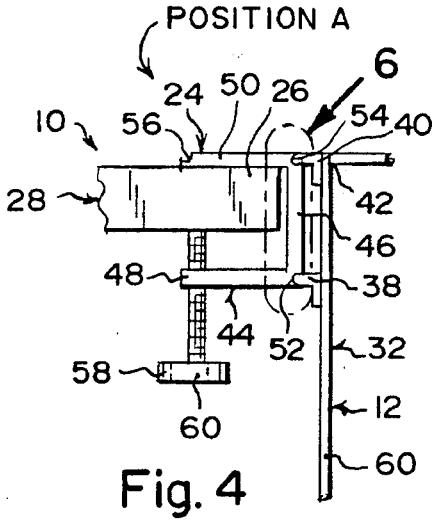
FIG. 4 is an enlarged side view of the two position clamp with a portion of the rack frame shown being held to a top edge of the table.

To use the dinnerware caddie 10 in the position A, as best shown in FIGS. 4 and 6, a person simply takes the clamp 44 and places the second transverse groove 54 against the upper projection 42 and pivots the rack frame 32 down until the lower projection 38 snaps into the first transverse groove 54. The clamp 44 can now be slipped onto the edge of the table top 26 and the retainer screw 58 tightened, so that the rack frame 32 will hang down therefrom.

Figure 5:
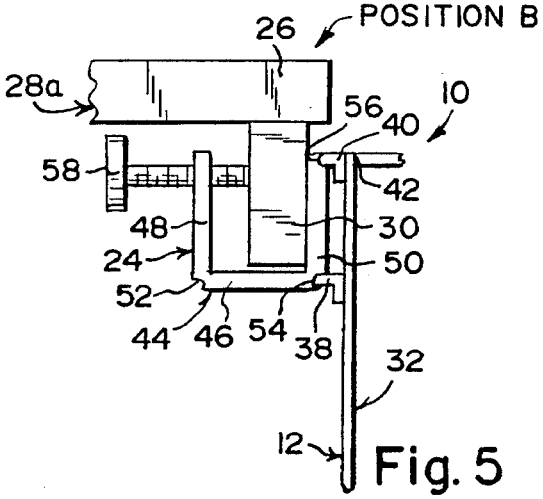
FIG. 5 is an enlarged side view of the two position clamp with a portion of the rack frame shown being held to an apron of the table.

To use the dinnerware caddie 10 in the position B, as best shown in FIG. 5, the person simply takes the clamp 44 and places the third transverse groove 56 against the upper projection 42 and pivots the rack frame 32 down until the lower projection 38 snaps into the second transverse groove 54. The clamp 44 can now be slipped up onto the apron 30 and the retainer screw 58 tightened, so that the rack frame 32 will hang down therefrom.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A dinnerware caddie which comprises:

a) means for holding a plurality of knives, forks, spoons, napkins and plates; and b) means for mounting said holding means in a first position to an edge of a top on a table and in a second position to an apron of a table, wherein said holding means includes a rack frame having a plurality of loading compartments for storing the knives, forks, spoons, napkins therein and a front loading compartment for storing the plates therein, wherein said mounting means includes:

i) said rack frame having a pair of spaced apart projections one above the other at the rear top edge thereof;

ii) a two position C-shaped clamp having a base, a first leg and a second leg with a first transverse groove on an intersection of said base and said first leg, a second transverse groove on an intersection of said base and said second leg and a third transverse groove at a free edge of said second leg; and iii) a retainer screw threaded through said first leg and extending towards said second leg, whereby said clamp can be oriented into said first position with said first groove engaging with said lower projection, said second groove engaging with said upper projection and said retainer screw pressing said second leg against the table top, whereby said clamp can be oriented into said second position with said second groove engaging with said lower projections, said third groove engaging with said upper projection and said retainer screw pressing said second leg against the apron.

2. A dinnerware caddie as recited in claim 1, wherein said rack frame, said clamp and said retainer screw are fabricated out of stainless steel.

3. A dinnerware caddie as recited in claim 1, wherein said rack frame, said clamp and said retainer screw are fabricated out of plastic.

* * * * *